US009658591B2

(12) United States Patent
Mitsui et al.

(10) Patent No.: US 9,658,591 B2
(45) Date of Patent: May 23, 2017

(54) CLEANING APPARATUS, PROCESS CARTRIDGE, AND IMAGE FORMING APPARATUS

(71) Applicant: CANON KABUSHIKI KAISHA, Tokyo (JP)

(72) Inventors: Yoshihiro Mitsui, Numazu (JP); Hideki Maeshima, Mishima (JP); Shuichi Gofuku, Numazu (JP); Go Shindo, Mishima (JP); Jun Miura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/077,072

(22) Filed: Mar. 22, 2016

(65) Prior Publication Data

US 2016/0291531 A1 Oct. 6, 2016

(30) Foreign Application Priority Data

Mar. 30, 2015 (JP) ..... 2015-069583

(51) Int. Cl.

| | |
|---|---|
| ***G03G 21/00*** | (2006.01) |
| ***G03G 21/16*** | (2006.01) |
| ***G03G 21/12*** | (2006.01) |
| ***G03G 21/18*** | (2006.01) |

(52) U.S. Cl.

CPC ..... *G03G 21/169* (2013.01); *G03G 21/0011* (2013.01); *G03G 21/12* (2013.01); *G03G 21/1814* (2013.01)

(58) Field of Classification Search

CPC ..... G03G 21/169; G03G 21/0005; G03G 21/0011; G03G 2221/1618; G03G 21/12; G03G 21/1814

USPC ..... 399/343, 347, 350

See application file for complete search history.

(56) References Cited

U.S. PATENT DOCUMENTS

| | | | | |
|---|---|---|---|---|
| 6,993,281 | B2 * | 1/2006 | Yoshizawa | G03G 21/0035 399/350 X |
| 8,594,527 | B2 | 11/2013 | Nagae et al. | |
| 2006/0216082 | A1 * | 9/2006 | Kojima | G03G 21/0011 399/350 |
| 2010/0215417 | A1 * | 8/2010 | Fujimori | G03G 21/0011 399/350 X |

FOREIGN PATENT DOCUMENTS

JP H04-245285 A 9/1992

OTHER PUBLICATIONS

U.S. Appl. No. 15/077,054, filed Mar. 22, 2016.

* cited by examiner

*Primary Examiner* — Sophia S Chen

(74) *Attorney, Agent, or Firm* — Fitzpatrick, Cella, Harper & Scinto

(57) ABSTRACT

An object of the present invention is to reduce noise which results from vibration of a cleaning member. A cleaning apparatus 23 includes a cleaning member 3 that removes developer on an image bearing member 1, a container 5 in which the developer removed by the cleaning member 3 is contained, and a sheet member 4 that contacts the image bearing member 1. A part of the sheet member 4 that contacts the image bearing member 1 is subjected to surface roughing.

10 Claims, 2 Drawing Sheets

CLEANING APPARATUS, PROCESS CARTRIDGE, AND IMAGE FORMING APPARATUS

BACKGROUND OF THE INVENTION

Field of the Invention

The present invention relates to a cleaning apparatus that removes toner remaining on photosensitive drums, a process cartridge, and an image forming apparatus.

Description of the Related Art

In image forming apparatuses proposed in the prior art which employ an electrophotographic technique, toner images formed on photosensitive drums are transferred to a recording medium so as to form images on the recording medium (U.S. Pat. No. 8,594,527). In many cases, such image forming apparatuses are provided with a cleaning apparatus that collects remaining toner which remains on the photosensitive drums after the toner images have been transferred. The cleaning apparatus includes a cleaning member that removes the remaining toner on the photosensitive drums, a collection container in which the remaining toner is contained, and a collection sheet member that restrains the remaining toner in the collection container from leaking to the outside of the collection container.

In the prior art, vibration of the cleaning member may cause "noise". Such occurrence of noise is undesirable to users who use the image forming apparatus in an office environment. The noise occurs when the photosensitive drums and a developing apparatus become worn away, increasing a coefficient of friction μ of the surfaces of the photosensitive drums. An increased coefficient of friction μ of the surfaces of the photosensitive drums causes a stick-slip of the cleaning member. The resultant vibration is transmitted to the collection container to cause the noise. Stick-slip is a spontaneous vibration resulting from repeated adhesion and slippage between friction surfaces. To suppress the noise, the coefficient of friction μ of the surfaces of the photosensitive drums needs to be kept small from the first use of the photosensitive drums until the lives of the photosensitive drums come to an end.

In Japanese Patent Application Laid-open No. H4-245285, a coating layer containing lubricative particles is provided in a part of a collection sheet member that contacts the photosensitive drum. Herein, the lubricative particles are fed from the collection sheet to the surface of the photosensitive drum to reduce the coefficient of friction μ of the surface of the photosensitive drum. The reduced coefficient of friction μ of the surface of the photosensitive drum suppresses noise resulting from vibration of the cleaning member.

However, the invention disclosed in Japanese Patent Application Laid-open No. H4-245285 requires an operation of forming the coating layer containing the lubricative particles and, moreover, material costs for the lubricative particles are high, these aspects leading to an increase in the production costs for the image forming apparatus.

SUMMARY OF THE INVENTION

Under these circumstances, an object of the present invention is to provide a technique for reducing noise which results from vibration of a cleaning member.

An object of the present invention is to provide a cleaning apparatus comprising:

a cleaning member that removes developer on an image bearing member;

a container in which the developer removed by the cleaning member is contained; and a sheet member that contacts the image bearing member, wherein surface roughing is applied on a contact part of the sheet member that contacts the image bearing member Another object of the present invention is to provide a process cartridge and an image forming apparatus.

The present invention enables a reduction in noise which results from vibration of the cleaning member.

Further features of the present invention will become apparent from the following description of exemplary embodiments with reference to the attached drawings.

DESCRIPTION OF THE EMBODIMENTS

Embodiments of the present invention will be described below with reference to the drawings. However, the dimensions, materials, shapes, relative arrangements, etc. of the components described in the embodiments should be changed, as appropriate, according to the configuration of and various conditions for an apparatus to which the invention is applied, and are not intended to limit the scope of the present invention to the following embodiments.

Embodiment 1

<Image Forming Apparatus>

Figure 1:
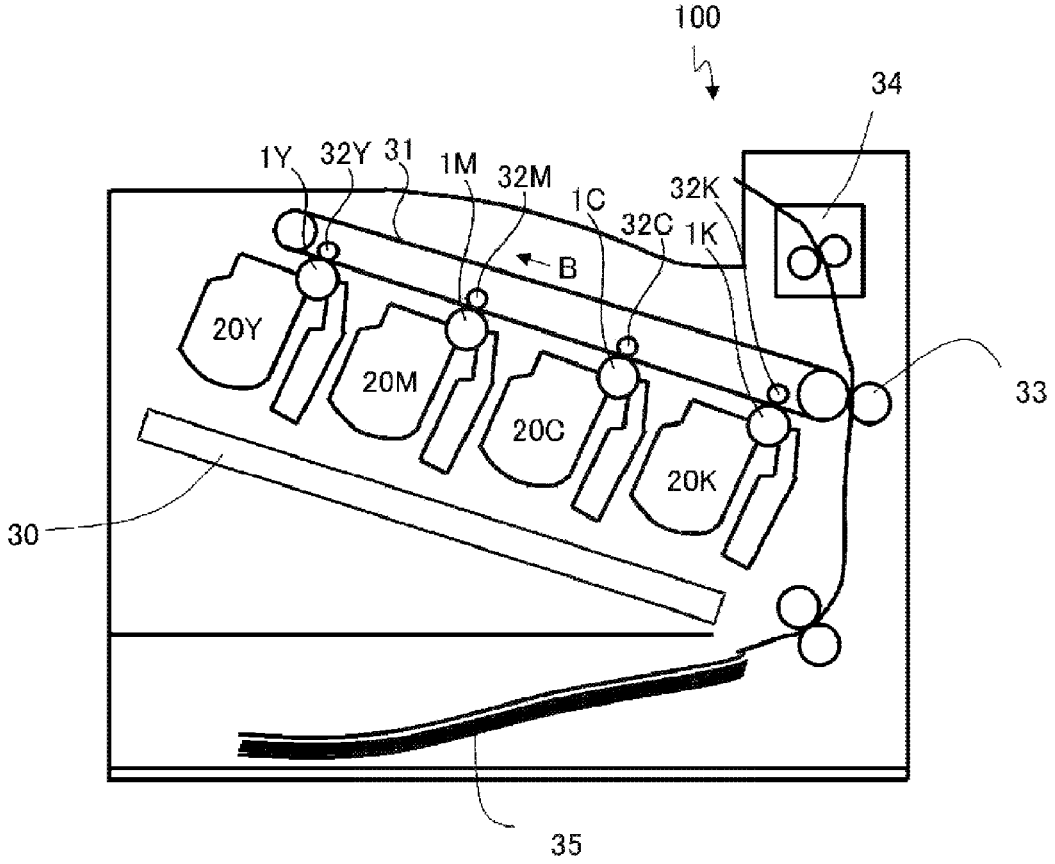
FIG. 1 is a schematic sectional view of an image forming apparatus according to Embodiment 1.
Figure 2:
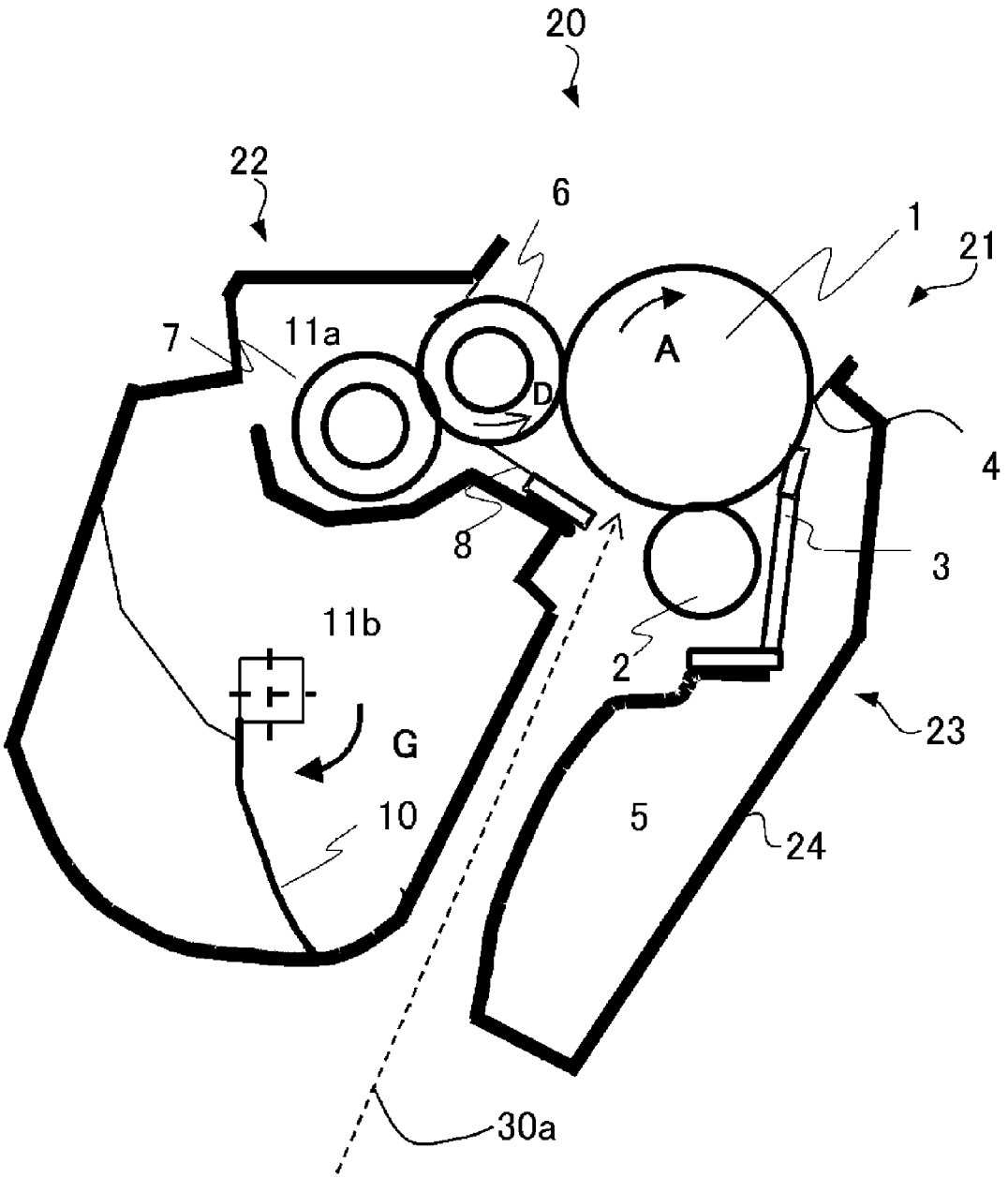
FIG. 2 is a schematic sectional view of a process cartridge according to Embodiment 1.

A general configuration of an electrophotographic image forming apparatus (image forming apparatus) will be described. FIG. 1 is a schematic sectional view of an image forming apparatus according to Embodiment 1. FIG. 2 is a schematic sectional view of a process cartridge according to Embodiment 1. An image forming apparatus 100 is a full-color laser beam printer for which an in-line system and an intermediate transfer system are adopted. The image forming apparatus 100 allows full-color images to be formed on recording media (for example, recording paper, plastic sheets, or cloths) in accordance with image information.

The image information is input to the apparatus main body of the image forming apparatus 100 by an image reading apparatus connected to the apparatus main body of the image forming apparatus 100 or host equipment, e.g. a personal computer, that is connected to the apparatus main body of the image forming apparatus 100 so as to be able to communicate therewith. The image forming apparatus 100 has process cartridges 20 as a plurality of image forming portions. In the present embodiment, the image forming apparatus 100 has four process cartridges 20Y to 20K that allow formation of images in yellow (Y), magenta (M), cyan (C), and black (K), respectively. The process cartridges 20Y to 20K in the present embodiment are similarly configured except for the color of toner contained in the process cartridge. Thus, unless otherwise specified, suffixes Y to K are omitted, and the process cartridges 20Y to 20K are collectively described. Of course, the process cartridges may vary in shape or size.

In the present embodiment, the process cartridges 20Y to 20K are arranged in the image forming apparatus 100 adjacently to one another. The process cartridges 20 can be installed in and removed from the image forming apparatus 100 via an installation guide (not depicted in the drawings) or a positioning member (not depicted in the drawings) provided in the apparatus main body of the image forming apparatus 100. In the present embodiment, although the process cartridges 20 can be installed in and removed from the image forming apparatus 100, a developing unit 22 (as developing apparatus), a photosensitive unit 21, a cleaning apparatus 23, and the like may be individually installed in and removed from the image forming apparatus 100.

Photosensitive drums 1 (as image bearing members) that are rotating members are rotationally driven by driving means not depicted in the drawings. A scanner unit 30 is arranged in the image forming apparatus 100. The scanner unit 30 radiates laser light based on the image information to form an electrostatic latent image on each of the photosensitive drums 1 (as image bearing members). In a main scanning direction (the direction orthogonal to a conveying direction of recording medium), exposure to laser light is performed on each scan line based on BD signals. On the other hand, in a sub-scanning direction (the conveying direction of the recording medium), exposure to laser light is delayed by a predetermined time based on TOP signals that use a switch (not depicted in the drawings) in a sheet conveying path (not depicted in the drawings) as a start point. Thus, for the four process cartridges 20Y to 20K, the same positions on the respective photosensitive drums 1 can constantly be exposed to laser light.

An intermediate transfer belt 31 is arranged in the image forming apparatus 100 opposite to the photosensitive drums 1 to transfer the toner images (developer images) on the photosensitive drums 1 to the recording medium 35. The intermediate transfer belt 31, which is an endless belt, moves cyclically in the direction of arrow B in FIG. 1 in contact with the photosensitive drums 1. On an inner peripheral surface side of the intermediate transfer belt 31, four primary transfer rollers 32 (32Y to 32K) are arranged opposite to the respective four photosensitive drums 1 as primary transfer means.

A primary transfer bias power source (not depicted in the drawings) serving as primary transfer bias applying means applies a bias with a polarity opposite to a regular charging polarity of the toner to the primary transfer rollers 32. The regular charging polarity of the toner refers to the polarity of the toner used for development. In the present embodiment, toner with a negative polarity corresponds to toner with the regular charging polarity. Thus, the toner images on the photosensitive drums 1 (as image bearing members) are transferred onto the intermediate transfer belt 31 (primary transfer). A secondary transfer roller 33 serving as secondary transfer means is arranged on an outer peripheral surface side of the intermediate transfer belt 31.

A secondary transfer bias power source (not depicted in the drawings) serving as secondary transfer bias applying means applies a bias with the polarity opposite to the regular charging polarity of the toner to the secondary transfer rollers 33. Thus, the toner images on the intermediate transfer belt 31 are transferred onto the recording medium 35 (secondary transfer). For example, when a full-color image is formed, the above-described process is sequentially executed on the process cartridges 20Y to 20K to sequentially lay the toner images in the respective colors on top of one another on the intermediate transfer belt 31.

The recording medium 35 is conveyed, in synchronism with movement of the intermediate transfer belt 31, to a secondary transfer portion that is a nip between the intermediate transfer belt 31 and the secondary transfer roller 33. The toner images in the four colors on the intermediate transfer belt 31 are secondarily transferred onto the recording medium 35 by the secondary transfer roller 33 that is in contact with the intermediate transfer belt 31 via the recording medium 35. The recording medium 35 with the toner images transferred thereto is subsequently conveyed to a fixing apparatus 34 serving as fixing means. The recording medium 35 with the toner images transferred thereto is heated and pressured by the fixing apparatus 34 to fix the toner images to the recording medium 35.

<Process Cartridge>

Now, a general configuration of the process cartridges 20 according to the present invention will be described using FIG. 2. Each of the process cartridges 20 includes a photosensitive unit 21 having the photosensitive drum 1, etc. and a developing unit (developing apparatus) 22 having a developing roller 6, etc. The photosensitive unit 21 includes the photosensitive drum 1 and the cleaning apparatus 23 that removes remaining toner remaining on the photosensitive drum 1. The cleaning apparatus 23 has at least a cleaning member 3, a collection sheet member 4 (sheet member 4), and a collection container 5 (container). In the present embodiment, the cleaning apparatus 23 further has a charging roller 2. In the cleaning apparatus 23, the cleaning member 3 contacts the photosensitive drum 1 to remove the toner remaining on the surface of the photosensitive drum 1.

The photosensitive drum 1 is rotatably attached to the photosensitive unit 21 via a bearing not depicted in the drawings. The photosensitive drum 1 is subjected to a driving force of a driving motor not depicted in the drawings, so as to be rotationally driven in the direction of arrow A in FIG. 2 in accordance with an image forming operation. The photosensitive unit 21 has the charging roller 2, the cleaning member 3, the collection sheet member 4, and the collection container 5. The charging roller 2, the cleaning member 3, and the collection sheet member 4 are arranged in contact with the photosensitive drum 1.

A charging bias power source not depicted in the drawings applies a bias to the charging roller 2. In the present embodiment, a bias is applied to the charging roller 2 so as to set a potential Vd on the photosensitive drum 1 to −500 V. Then, the scanner unit 30 irradiates the photosensitive drum 1 with laser light 30*a* to form an electrostatic latent image on the charged photosensitive drum 1. The cleaning member 3 is formed by shaping polyurethane rubber on a metal support member. The cleaning member 3 contacts the photosensitive drum 1 in a counter direction of a rotating direction of the photosensitive drum 1.

In the present embodiment, the metal support member forming the cleaning member 3 has a thickness of 1.2 mm to 2.0 m, and the polyurethane rubber has a hardness of 60° to 80° (Wallace hardness). As the polyurethane rubber, a tip-cured blade may be used in which only a part of the polyurethane rubber that contacts the photosensitive drum 1 is cured. The cleaning member 3 removes toner remaining on the photosensitive drum 1 after the toner images are transferred from the photosensitive drum 1 to the intermediate transfer belt 31. The toner removed by the cleaning member 3 is stored in the collection container 5 (container). The collection sheet member 4 is a characteristic part of the present embodiment and will thus be described below in detail.

The developing unit 22 has a developing chamber 11*a* and a developer containing chamber 11*b*. In the present embodiment, the developer containing chamber 11*b* is arranged below the developing chamber 11*a*. The toner serving as developer is contained inside the developer containing chamber 11*b*. In the present embodiment, the regular charging polarity of the toner is negative. An image forming operation performed when toner with negative charging performance is used will be described below. However, in the present embodiment, the toner used for image formation is not limited to the toner with the negative charging performance.

The developer containing chamber 11*b* is provided with a toner conveying member 10 configured to convey the toner in the developer containing chamber 11*b* to the developing chamber 11*a*. The toner conveying member 10 rotates in the direction of arrow G in FIG. 2 to convey the toner to the developing chamber 11*a*. The developing chamber 11*a* is provided with the developing roller 6, which rotates in the direction of arrow D in FIG. 2 when the driving motor (not depicted in the drawings) exerts a driving force on the developing roller 6. The developing roller 6 rotates in contact with the photosensitive drum 1.

In the present embodiment, the developing roller 6 and the photosensitive drum 1 rotate so as to move in the same direction in an area where the developing roller 6 and the photosensitive drum 1 contact each other. A developing bias power source (not depicted in the drawings) applies, to the developing roller 6, a bias needed to develop the electrostatic latent image on the photosensitive drum 1. Inside the developing chamber 11*a*, a supply roller 7 is arranged which feeds the toner conveyed from the developer containing chamber 11*b* to the developing roller 6, and a regulating blade 8 is also arranged which regulates the amount of toner on the developing roller 6 and which also charges the toner on the developing roller 6.

In the present embodiment, the developing roller 6 has a diameter of ϕ15 mm and is formed by covering a conductive cored bar of ϕ6 mm in diameter with silicone rubber to form a base layer and then covering this base layer with urethane rubber. The developing roller 6 used may have a volume resistance of $10^4$ to $10^{12}\Omega$. The supply roller 7 is a conductive elastic sponge roller of ϕ15 mm in diameter obtained by forming a foam layer to a conductive cored bar of ϕ6 mm in diameter.

The supply roller 7 used may have a volume resistance of $10^4$ to $10^8\Omega$. In the present embodiment, the supply roller 7 has a resistance value of $4\times10^6\Omega$ and a hardness of 200 gf. The hardness of the supply roller 7 in the present embodiment was determined by measuring a load imposed when a flat plate with a longitudinal length of 50 mm was allowed to cut into a surface of the supply roller 7 by 1 mm.

The regulating blade 8 is a metal plate with a thickness of 0.1 mm and contacts the developing roller 6 in a counter direction of a rotating direction of the developing roller 6. In the present embodiment, the regulating blade 8 is formed by cutting an SUS (stainless steel) metal plate from a side of the plate that is brought into contact with the developing roller 6 toward a side of the pate that is not brought into contact with the developing roller 6. High-voltage applying means not depicted in the drawings applies a developing bias to the developing roller 6 and the supply roller 7.

As the developing roller 6 rotates, the toner fed to the developing roller 6 by the supply roller 7 is conveyed to a position where the regulating blade 8 comes into contact with the developing roller 6. Thus, the toner on the developing roller 6 is triboelectrically charged by being rubbed by the regulating blade 8, with the thickness of the toner layer on the developing roller 6 adjusted. The developing roller 6 rotates to convey the toner on the developing roller 6 with the layer thickness thereof adjusted to the photosensitive drum 1. Thus, the electrostatic latent image on the photosensitive drum 1 is developed into a toner image.

<Developer>

Now, the developer used for the image forming apparatus 100 will be described. The developer in the present embodiment is toner with negative charging performance that is a nonmagnetic one-component developer. Silica particulates are externally added to the periphery of the toner as an external additive. In the present embodiment, silica particulates were externally added such that, when the weight of resin toner particles is 100 wt %, the rate of the external additive (the percentage by weight of the external additive) was 0.5 wt % to 2.0 wt %. However, the present invention is not limited to this, and a magnetic developer or a two-component developer may be used.

In the present embodiment, the toner used may have a toner particle size of 5 to 9 μm in terms of median size (d50). Toner may be used in which the external additive has a particle size of 10 to 300 nm. The external additive used may be, besides silica particulates, particulates of titanium oxide, aluminum oxide, zinc oxide, cerium oxide, tin oxide, strontium titanate, or the like. The toner used may have a degree of agglomeration of 5% to 50% in an initial state (in the state where the developing unit 22 is unused).

The degree of agglomeration was measured as described below. As a measurement apparatus, a powder tester (manufactured by HOSOKAWA MICRON CORPORATION) was used which had a digital vibration meter (DEGITAL VIBRATION METER MODEL 1332 manufactured by SHOWA SOKKI CORPORATION). When the degree of agglomeration of the toner was measured, sieves with 390, 200, and 100 meshes were set in order of decreasing number of meshes. In other words, the 390-mesh sieve, the 200-mesh sieve, and the 100-mesh sieve were laid on top of one another in order such that the 100-mesh sieve was located at the uppermost position.

An accurately weighed 5-g sample (toner) was added onto the set 100-mesh sieve, and displacement of the digital vibration meter was adjusted to 0.60 mm (peak-to-peak). Then, a shaking table was vibrated for 15 seconds. Subsequently, the mass of the sample remaining on each sieve was measured to determine the degree of agglomeration based on an expression described below. The measurement sample was toner left in an environment with a temperature of 23° C. and a relative humidity of 60% for 24 hours. The measurement was performed in an environment with a temperature of 23° C. and a relative humidity of 60%.

The degree of agglomeration (%)=(the mass of the remaining sample on the 100-mesh sieve/5 g)×100+(the mass of the remaining sample on the 200-mesh sieve/5 g)×60+(the mass of the remaining sample on the 390-mesh sieve/5 g)×20

<Collection Sheet Member 4>

Now, the collection sheet member 4 will be described. As depicted in FIG. 2, the collection sheet member 4 is a component of the photosensitive unit 21 having the photosensitive drum 1, the charging roller 2, the cleaning member 3, and the collection container 5. When the toner remaining on the photosensitive drum 1 is removed by the cleaning member 3 after the toner image is transferred to the intermediate transfer belt 31, the removed toner is stored in the collection container 5. The collection sheet member 4 restrains the stored toner from leaking to the outside of the collection container 5.

In the present embodiment, the collection sheet member 4 is bonded, with a double-sided tape or by laser welding, to a bonding surface provided on a frame 24 (as cleaning frame) forming the collection container 5. The collection sheet member 4 extends in an axial direction of the center of rotation of the photosensitive drum 1 and is bonded to the frame 24 so as to contact the photosensitive drum 1. With the collection sheet member 4 bonded to the frame 24, a free end (leading end) of the collection sheet member 4 extends from an upstream side to a downstream side in the rotating direction of the photosensitive drum 1 and contacts the photosensitive drum 1. The collection sheet member 4 contacts an outer peripheral surface of the photosensitive drum 1 further on the upstream side in the rotating direction of the photosensitive drum 1 with respect to a position where the cleaning member 3 contacts the photosensitive drum 1. The collection sheet member 4 closes the gap between the photosensitive drum 1 and the frame 24 (as cleaning frame) so as to prevent the toner contained in the collection container 5 from leaking through the gap.

The cleaning member 3 is in contact with the photosensitive drum 1 in the counter direction of the rotating direction (A direction) of the photosensitive drum 1, whereas the collection sheet member 4 is in contact therewith in the rotating direction of the photosensitive drum 1. A space where the cleaning member 3 and the collection sheet member 4 lie opposite to each other is continuous with the inside of the collection container 5. Thus, the toner removed from the photosensitive drum 1 is stored in the collection container 5 without leaking to the outside of the collection container 5 through the gap between the photosensitive drum 1 and the frame 24 (as cleaning frame).

In the present embodiment, fine unevenness is provided on a part of the collection sheet member 4 that contacts the photosensitive drum 1. The fine unevenness is formed by surface roughing to reduce a force that peels the external additive attached to the surface of the photosensitive drum 1 off from the surface. In the present embodiment, the part that is subjected to surface roughing is 3.00 μm in ten-point average roughness. The surface roughing is performed using, for example, sand blasting or rolling. The surface roughing need not be performed on a surface of the collection sheet member 4 that does not contact the photosensitive drum 1. A material for the sheet may be any sheet material such as PET or PPS. The collection sheet member 4 used may have a thickness of 30 to 200 μm.

Embodiment 2

Now, Embodiment 2 will be described. Embodiment 2 is different from Embodiment 1 in the roughness of the part of the collection sheet member 4 that contacts the photosensitive drum 1. In Embodiment 2, the part of the collection sheet member 4 subjected to surface roughing is 2.50 μm in ten-point average roughness.

<Experiment Results Indicative of Effects of the Invention>

Now, experiment results indicative of the effects of the embodiments will be described. To verify an effect that reduces "noise" resulting from vibration of the cleaning member 3, the process cartridges 20 in initial, middle, and last stages of life were checked for the presence or absence of "noise" in an environment with a temperature of 23° C. and a relative humidity of 50%. In Embodiment 1 and Embodiment 2, the collection sheet members 4 were used which varied in the roughness of the part of the collection sheet member 4 that contacted the photosensitive drum 1.

In Comparative Example 1, the surface roughing is not performed on the part of the collection sheet member 4 that contacts the photosensitive drum 1. The roughness of the part of the collection sheet member 4 that contacts the photosensitive drum 1 is lower in Comparative Example 2 than in Embodiment 1 and Embodiment 2. Table 1 and Table 2 indicate, for the collection sheet members 4 used in Embodiments 1 and 2 and Comparative Examples 1 and 2, the value of the roughness of the part of the collection sheet member 4 that contacts the photosensitive drum 1. A surface roughness measurement instrument of Surfcorder SE3500 manufactured by Kosaka Laboratory Ltd. was used to measure the roughness of the part of the collection sheet member 4 that contacted the photosensitive drum 1. The roughness values depicted in Table 1 and Table 2 are in accordance with ten-point average roughness Rz (JISB0601-1994).

Table 1 indicates the presence or absence of noise in Embodiments 1 and 2 and Comparative Examples 1 and 2. Table 2 indicates the amount of external additive attached to the surface of the photosensitive drum 1 in Embodiments 1 and 2 and Comparative Examples 1 and 2. Table 1 and Table 2 indicate the experiment results for the process cartridges 20 in the initial, middle, and last stages of life. In Table 1, cases where noise occurred are denoted by crosses, cases where no noise occurred are denoted by blank circles, and cases where a little noise occurred are denoted by blank triangles.

TABLE 1

Results of verification experiments on noise

| | Rz μm | Presence or absence of noise | | |
|---|---|---|---|---|
| | (1994) | Initial stage | Middle stage | Last stage |
| Embodiment 1 | 3.00 | ○ | ○ | ○ |
| Embodiment 2 | 2.50 | ○ | ○ | ○ |
| Comparative Example 1 | 0.38 | ○ | x | x |
| Comparative Example 2 | 1.90 | ○ | ○ | Δ |

TABLE 2

State of attachment of the external additive on the photosensitive drum 1

| | Rz μm | Amount of external additive attached | | |
|---|---|---|---|---|
| | (1994) | Initial stage | Middle stage | Last stage |
| Embodiment 1 | 3.00 | Large amount | Large amount | Large amount |
| Embodiment 2 | 2.50 | Large amount | Large amount | Large amount |
| Comparative Example 1 | 0.38 | Large amount | Small amount | Very small amount |
| Comparative Example 2 | 1.90 | Large amount | Large amount | Medium amount |

As depicted in Table 1, in Embodiment 1 and Embodiment 2, no noise occurred in the process cartridges 20 in the initial to last stages of life. On the other hand, in Comparative Example 1 with no surface roughing (Rz=0.38 μm), no noise occurred in the process cartridge 20 in the initial stage of life, whereas noise occurred in the process cartridges 20 in the middle and last stages of life. In Comparative Example 2 (Rz=1.9 μm), a little noise occurred in the process cartridge 20 in the last stage of life.

As depicted in Table 2, in Embodiment 1 and Embodiment 2, a large amount of external additive was attached to the surface of the photosensitive drum 1 in the process cartridges 20 in the initial to last stages of life. In Comparative Example 1, a large amount of external additive was attached to the surface of the photosensitive drum 1 in the process cartridge 20 in the initial stage of life. However, a smaller amount of external additive was attached to the surface of the photosensitive drum 1 in the process cartridge 20 in the middle stage of life, and a very small amount of external additive was attached to the surface of the photosensitive drum 1 in the process cartridge 20 in the last stage of life. In Comparative Example 2, a large amount of external additive was attached to the surface of the photosensitive drum 1 in the process cartridges 20 in the initial and middle stages of life, but a slightly smaller amount of external additive was attached to the surface of the photosensitive drum 1 in the process cartridge 20 in the last stage of life. Table 1 and Table 2 indicate that noise occurs when a smaller amount of external additive is attached to the surface of the photosensitive drum 1.

The noise resulting from vibration of the cleaning member 3 often occurred when the developing unit 22 in the process cartridge 20 stopped being driven, with only the photosensitive unit 21 being driven. Specifically, the noise occurred when [1] the photosensitive drum 1 rotated before the image forming operation or the photosensitive drum 1 rotated after the image forming operation, and when [2] the photosensitive drum 1 rotated in order to perform density correction control for the image forming apparatus. The noise also occurred when [3] only the process cartridge 20K (black) performed a printing operation, with the process cartridges 20 for the other colors not performing the printing operation but with the photosensitive unit 21 rotating (what is called a monochromatic mode). The noise also occurred when [4] the photosensitive unit 21 rotated in order to clean the toner on the intermediate transfer belt.

Now, effects of Embodiment 1 and Embodiment 2 will be described. The external additive externally added to the toner is freed from the toner and attached to the surface of the photosensitive drum 1 during durability tests. The external additive freed from the toner functions as a lubricant to reduce the coefficient of friction μ of the surface of the photosensitive drum 1. With a large amount of external additive attached to the photosensitive drum 1, a frictional force exerted between the cleaning member 3 and the photosensitive drum 1 decreased to suppress a stick-slip of the cleaning member 3 and thus possible noise.

As depicted in Table 2, in Embodiment 1 and Embodiment 2, the part of the collection sheet member 4 that contacts the photosensitive drum 1 has a high Rz enough to keep a large amount of external additive attached on the photosensitive drum 1 during the durability tests. This is expected to be due to a reduced contact area between the photosensitive drum 1 and the collection sheet member 4 resulting from the unevenness formed on the collection sheet member 4.

The reduced contact area between the photosensitive drum 1 and the collection sheet member 4 decreases the area of a part of the surface of the photosensitive drum 1 that is rubbed by the collection sheet member 4. This in turn reduces the area of a part of the surface of the photosensitive drum 1 from which the external additive is peeled off. Thus, a large amount of external additive is kept attached to the surface of the photosensitive drum 1 until the process cartridge 20 reaches the last stage of life. This enables a reduction in possible noise resulting from vibration of the cleaning member 3.

As in [1] to [4] described above, the noise is likely to occur while only the photosensitive unit 21 is being driven with the developing unit 22 not being driven. This is because the developing roller 6 in the developing unit 22 fails to contact the photosensitive drum 1, reducing the amount of external additive fed to the photosensitive drum 1. In Comparative Example 1 and Comparative Example 2, since the external additive on the photosensitive drum 1 is peeled off, the noise occurs, for example, while only the photosensitive unit 21 is being driven.

However, according to Embodiment 1 and Embodiment 2, when the part of the collection sheet member 4 that contacts the photosensitive drum 1 is subjected to surface roughing, the external additive is unlikely to be peeled off from the surface of the photosensitive drum 1. Thus, a large amount of external additive is kept attached to the photosensitive drum 1 to enable a reduction in possible noise. The experiment results indicate that, as depicted in Table 1, possible noise is reduced when the ten-point average roughness Rz (JISB0601-1994) is 2.5 μm or more.

On the other hand, when the ten-point average roughness Rz is 10 μm or more, the gap between the collection sheet member 4 and the photosensitive drum 1 is larger than the toner particle size, possibly causing the toner to leak from the collection container 5. Therefore, the part of the collection sheet member 4 that contacts the photosensitive drum 1 desirably has a ten-point average roughness Rz of 2.5 μm to 10.0 μm. Possible noise resulting from vibration of the cleaning member 3 was also suppressed when the part of the collection sheet member 4 that contacted the photosensitive drum 1 had an arithmetic-mean roughness Ra (JIS B0601-1994) of 0.35 μm to 0.8 μm.

This is expected to be because, while the developing unit 22 is being driven, the external additive or fogging toner from the developing unit is attached to the surface of the photosensitive member to reduce possible noise.

As described above, in Embodiment 1, the unevenness is formed on the contact part of the sheet member that contacts the image bearing member. The external additive is restrained from being peeled off from the image bearing member by reducing the size of the area where the sheet member and the image bearing member contact each other. This enables a reduction in possible noise resulting from the contact of the cleaning member with the image bearing member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-069583, filed Mar. 30, 2015, which is hereby incorporated by reference herein in its entirety.

What is claimed is:

1. A cleaning apparatus comprising:

a cleaning member that removes a developer on an image bearing member;

a container in which the developer removed by the cleaning member is contained; and a sheet member that contacts the image bearing member, wherein the cleaning member contacts the image bearing member on which a developer image is formed using developer with an external additive added thereto, so as to remove the developer on the image bearing member, and wherein a contact part of the sheet member that contacts the image bearing member is subjected to surface roughing so as to reduce a force that peels the external additive attached to a surface of the image bearing member off from the surface of the image bearing member.

2. The cleaning apparatus according to claim 1, wherein unevenness is formed, by the surface roughing, on the contact part of the sheet member.

3. The cleaning apparatus according to claim 1, wherein the contact part of the sheet member has a ten-point average roughness of 2.5 μm to 10.0 μm.

4. The cleaning apparatus according to claim 1, wherein the contact part of the sheet member has an arithmetic-mean roughness of 0.35 μm to 0.80 μm.

5. The cleaning apparatus according to claim 1, further comprising a cleaning frame which forms the container and to which the cleaning member is attached, wherein the sheet member is attached to the cleaning frame.

6. The cleaning apparatus according to claim 5, wherein the cleaning member contacts the image bearing member in a counter direction of a rotating direction of the image bearing member, wherein the sheet member contacts the image bearing member in the rotating direction of the image bearing member, and wherein a space where the cleaning member and the sheet member lie opposite to each other is continuous with an inside of the container.

7. The cleaning apparatus according to claim 1, wherein the image bearing member is a rotating member, and wherein the sheet member contacts an outer peripheral surface of the image bearing member further on an upstream side in a rotating direction of the image bearing member with respect to a position where the cleaning member contacts the image bearing member.

8. The cleaning apparatus according to claim 1, wherein the image bearing member is a photosensitive drum.

9. A process cartridge comprising:

the cleaning apparatus according to claim 1;

the image bearing member; and a developing apparatus that feeds developer used to form a developer image to the image bearing member.

10. An image forming apparatus comprising:

the cleaning apparatus according to claim 1, wherein an image is formed on a recording medium using developer.

* * * * *